United States Patent [19]

Hild et al.

[11] Patent Number: 4,530,224

[45] **Date of Patent: * Jul. 23, 1985**

[54] STRIP-GUIDE ASSEMBLY FOR A METAL STRIP COILER

[75] Inventors: Berthold Hild, Burbach-Walbach; Martin Braun, Kreuztal-Fernsdorf; Max Münker, Hilchenbach, all of Fed. Rep. of Germany

[73] Assignee: SMS Schloemann-Siemag AG, Düsseldorf, Fed. Rep. of Germany

[ * ] Notice: The portion of the term of this patent subsequent to Sep. 20, 2000 has been disclaimed.

[21] Appl. No.: 533,609

[22] Filed: Sep. 19, 1983

Related U.S. Application Data

[63] Continuation-in-part of Ser. No. 283,004, Jul. 13, 1981, Pat. No. 4,404,831.

[30] Foreign Application Priority Data

Jul. 12, 1980 [DE] Fed. Rep. of Germany ..... 3026524
Mar. 5, 1983 [DE] Fed. Rep. of Germany ..... 3307840

[51] Int. Cl.[3] ..... B21C 47/06

[52] U.S. Cl. ..... 72/15; 72/21; 72/148; 242/78.1

[58] Field of Search ..... 72/14, 15, 21–24, 72/146, 148, 371; 242/66, 78, 78.1

[56] References Cited

U.S. PATENT DOCUMENTS

| | | | |
|---|---|---|---|
| 1,882,219 | 10/1932 | Harwood et al. | 72/148 X |
| 2,756,942 | 7/1956 | Sieger | 72/148 |
| 3,028,114 | 4/1962 | Asbeck | 72/148 X |
| 3,073,543 | 1/1963 | Bond | 72/148 |
| 3,328,990 | 7/1967 | Sieger et al. | 72/148 |
| 4,063,440 | 12/1977 | Brashear | 72/148 |
| 4,380,164 | 4/1983 | Kuwano | 72/21 |
| 4,404,831 | 9/1983 | Hild et al. | 72/148 |
| 4,455,848 | 6/1984 | Tippens et al. | 72/148 X |

FOREIGN PATENT DOCUMENTS

| | | | |
|---|---|---|---|
| 546126 | 6/1942 | United Kingdom | 72/148 |

*Primary Examiner*—E. Michael Combs
*Attorney, Agent, or Firm*—Karl F. Ross; Herbert Dubno

[57] ABSTRACT

One or more positioning devices in the form of pneumatic-hydraulic cylinders can be connected to one or more carriers for pressing rollers and/or guide plates of a strip coiler. At least one of the pneumatic-hydraulic positioning devices is suspended from the top and has a hydraulic piston emerging from a hydraulic cylinder at its lower end for connection by a linkage of a respective carrier while the upper end of the hydraulic cylinder forms the piston in the pneumatic cylinder.

14 Claims, 5 Drawing Figures

STRIP-GUIDE ASSEMBLY FOR A METAL STRIP COILER

CROSS REFERENCE TO RELATED APPLICATION

This application is a continuation-in-part of Ser. No. 283,004, filed July 13, 1981, now U.S. Pat. No. 4,404,831.

FIELD OF THE INVENTION

Our present invention relates to a strip-guide assembly for a metal-strip coiler and especially a subfloor coiler adapted to be disposed along a hot-rolling strip-mill line. The invention especially is intended for the control of the pressing roller and/or guide plates or shells for such coilers.

BACKGROUND OF THE INVENTION

In the production of metal strip, e.g. steel strip by the hot rolling of slabs in a hot-rolling line, the strip which is fabricated may be coiled on a mandrel to form a strip coil or reel in a conventional band or strip coiler located beneath the floor of the strip mill.

Such strip coilers are referred to as subfloor coilers and comprise, in addition to the mandrel, a plurality of guide or pressing elements which are disposed in angularly spaced relationship about this mandrel and serve to press the oncoming strip thereagainst and against previously wound turns, or to guide the strip onto the mandrel or onto the previously formed turns.

Such guide or pressing means can include pressing rollers or rolls which are rotatable about axes parallel to the mandrel axis. The guide or deflecting plates may be in the form of arcuate shells which extend along a portion of the arc of the coil and can define a narrow gap therewith so that they can serve to deflect the strip onto the coil or the mandrel.

It is common to provide such guide or pressing elements, or both, upon an assembly which is capable of adjusting the position between the mandrel surface and the pressing or guide element, i.e. the roll or plate.

Such an assembly can comprise a so-called four-pivot linkage having at least two arms, each of which is pivotally connected at one end to a head carrying the pressing or guide element.

The other ends of these arms are pivoted as well so that the pivots and the two arms form the vertices and two sides of a quadrilateral and any displacement of the linkage results in a displacement of the pressing roll or guide plate generally parallel to itself toward or away from the mandrel.

This linkage can be actuated by a combined pneumatic/hydraulic unit which serves for closing and opening the pressing roll assembly with respect to the coiling mandrel.

Subfloor strip coilers for hot-rolling strip mills have generally comprised in the past a large volume pneumatic cylinder which serves to position the pressing rollers, i.e. moving them toward and away from the mandrel and correspondingly displacing any deflecting or guide shell.

Such large volume pneumatic cylinders have been found to be disadvantageous in practice when the pressing roll or guide shell is to be swung toward or away from the mandrel.

As is described in *Technical Review*, February 1978, Mitsubishi Heavy Industries, Ltd., pages 1–10, a hydraulic shock absorber can be combined with a pneumatic cylinder for the pressing rolls or guide shells of subfloor strip coilers Such hydraulic shock absorbers differ from conventional hydraulic cylinders in that the piston rod of the shock absorber contains a piston-forming pressure accumulator. The latter accumulator has on one side compressed nitrogen gas while on the other side a hydraulic pressure is developed by a working piston displaceable in the hydraulic cylinder. By pressurization of the piston shiftable in this cylinder with fluid under pressure, the piston rod is brought into a position in which the pressure of the nitrogen gas is in equilibrium with the hydraulic pressure. The use of such a hydraulic shock absorber for actuating the position device for the pressure roll and/or a guide plate for a strip coiler has a significant advantage over pneumatic systems alone in that it allows a reduction in the stress which may result from the interaction of the pressure roller and the periphery of the strip coil during the coiling operation and also results in a more rapid presetting of the pressing roll by reducing the distance of the latter from the strip coil periphery.

With the strictly pneumatic control, the response of the pressing roll or the guide varied depending on the displacement of the pneumatically actuated piston while, in the arrangement of the hydraulic shock absorber, the operating characteristics of the nitrogen accumulator depended directly upon the prevailing working pressure of the fluid medium feed to the hydraulic cylinder. The spring rate of the nitrogen accumulator was thus a function of the prevailing working pressure of the hydraulic fluid and could not be selected independently thereof.

OBJECTS OF THE INVENTION

It is the principal object of the present invention to provide an improved apparatus of the type described, i.e. a positioning device for a pressing roll or guide plate of a strip coiler whereby the disadvantages of the aforedescribed devices can be obviated.

Another object of the invention is to provide an improved control arrangement for the strip-guide members of a subfloor strip coiler for a hot-rolling strip-mill line which provides a more reliable positioning of the controlled member with respect to the coil or mandrel surface.

It is also an object of the invention to provide a positioning unit capable not only of displacing the pressing roll against the surface of the coiling mandrel of a strip coiler prior to the in-feed of the forward end of the strip, but also a controlled outward deflection of the pressing roller after strip in-feed and for the application of the pressing roll to the periphery of the strip coil prior to the passage of the trailing strip end after a prepositioning of the roll during the coiling phase.

It is still a further object of the invention to provide a device for the purposes described which will allow application of the pressing roll from its preliminary position to the periphery of the coil prior to passage of the trailing end of the strip with a reduced or minimal velocity such that any impact energy against the coil is minimized.

Yet another object of the invention is to extend the principles of the above-identified application Ser. No. 283,004 by reducing the space required for the positioning device.

A corollary object of this invention is to provide a positioning device which occupies less space and can be positioned in a subfloor strip-coiler assembly more rationally than earlier devices including the device of the above-identified application and the corresponding German patent application DE-OS 30 26 524.

SUMMARY OF THE INVENTION

These objects and others which will become apparent hereinafter are attained, in accordance with the present invention in a positioning assembly for a guide member of a strip coiler, e.g. for the pressing roller and/or a guide plate for the incoming strip, which comprises a four-pivot linkage upon which the guide member is supported for movement toward and away from the coiling mandrel, and a pneumatic-hydraulic unit comprising a stroke-limited pneumatic cylinder and a hydraulic cylinder formed in the pneumatic cylinder and acting upon one of the arms of the linkage, the hydraulic pressurization of the hydraulic cylinder being independent from the pneumatic pressurization of the pneumatic cylinder.

The positioning device as thus constituted allows the primary movement to be controlled by the hydraulic cylinder and, via the hydraulic fluid flow, to control the speed so that it is maintained substantially constant, independently of load changes.

To initially position the pressing roll, e.g. for the feed of the strip onto the mandrel, the pneumatic cylinder is energized and displaces the roller toward the mandrel, the pneumatic pressure maintaining the pressing roll against displacement with a substantially constant spring rate or force because, in spite of the high compressibility of the air, a large volume of air is provided in the pneumatic cylinder and in the plunger-forming portion thereof which is axially elongated and can form or enclose the hydraulic cylinder. Because of this high volume, there is no noticeable force increase in the pneumatic cylinder upon displacement of the pressing roll.

According to another feature of the invention, the limited stroke of the pneumatic cylinder corresponds to the maximum swing or stroke of the pressing roll and/or the guide or deflection plate forming the guide member and the plunger piston is displaceable with the same stroke by the compressed air into its extended position. Building of the coil can result in displacement of the plunger piston into its retracted position.

This not only provides a minimum axial length for the hydraulic cylinder arrangement but also ensures that the primary positioning of the pressing roll is effected exclusively by the hydraulic cylinder and that a predetermined spring constant is maintained for the pneumatic cylinder.

According to yet another feature of the invention, the plunger piston of the pneumatic cylinder is formed as a hollow piston and coaxially surrounds the hydraulic cylinder with a chamber communicating continuously with the working chamber of the pneumatic cylinder. It has also been found to be advantageous to make the working stroke of the hydraulic cylinder greater than the limited stroke of the pneumatic cylinder and at least equal to the length of the plunger piston.

The hydraulically actuatable piston is preferably formed as a differential piston and the hydraulic pressurization means can include chambers on opposite side of this latter piston connected by respective ports to the hydraulic fluid valves.

In the above identified application and the corresponding German open application, we have solved many of the problems hitherto encountered with positioning devices for the strip-guide members of subfloor coiler assemblies.

However, the system described in these applications, while vastly superior to hitherto known positioning devices exclusively utilizing large-volume pneumatic cylinders, nevertheless required considerable space and indeed special compartments in the foundation or subfloor supporting structure, thereby markedly increasing the capital cost of the installation.

The system of the present invention improves upon the earlier systems of the aforementioned applications by eliminating the need for specially provided compartments and enables the positioning tubes to be disposed more rationally in conjunction with the foundation or conventional support structure of a subfloor coiler. This, of course, reduces the cost of the installation considerably.

More particularly, the present improvement relates to a positioning device for the pressing rollers and/or guide plates of strip coilers, especially subfloor strip coilers, in hot-rolling lines utilizing a combined pneumatic-hydraulic unit in which the pneumatic cylinder is stroke limited and receives a plunger or tubular piston forming the hydraulic cylinder which has a piston rod connected to the linkage by means of which the rollers or plates are actuated, the pneumatic and hydraulic cylinders being independently controllable, i.e. pressurizable.

According to this aspect of the invention, the plunger or tube piston which contains the hydraulic cylinder, is suspended from the pneumatic cylinder from the end of the tube piston remote from that at which the piston rod emerges so that the piston rod extends downwardly from the hydraulic cylinder to emerge from the tube piston. In other words, while the tube piston is oriented more or less in an upright position as in the systems of our aforementioned applications, it is secured to the pneumatic piston or cylinder at its upper end and the hydraulic piston rod emerges from its lower end to be connected pivotally to a linkage of the type previously described.

According to a further feature of the invention, the fluid pressure ports or passages for the working compartments of the hydraulic cylinder open upwardly from these compartments through the bottom of the plunger or tube piston. This bottom can be formed as the piston of the pneumatic cylinder. This greatly simplifies the construction of the tube or plunger piston and facilitates the supply of the hydraulic medium thereto.

According to still another feature of the invention, the plunger or tube piston is biased by the compressed air actuating the pneumatic cylinder into its retracted position.

The positioning device in which the support and guide elements for the rollers and deflecting plates constitute two levers links or arms pivotally mounted on a frame is particularly advantageous in the system of the present improvement since the piston rod of the hydraulic cylinder can be simply connected to these links or one of them by a bell-crank lever fulcrumed on the frame or support. A planar five-membered linkage can thus pivotally connect the rollers or guide plates to the support.

It is also possible, in accordance with the invention, to pivotally mount each of the members which are to be displaced by the positioning device relative to the coiling mandrel directly at a pivot axis fixed to the frame or support. In this case, the piston rod of the hydraulic cylinder can actuate the bell-crank lever which is pivotally connected to the other linkages so that the mounting assembly for the rollers and guide plates is constituted by a four-member linkage.

According to the invention, the positioning device need not only function to provide a stepwise or staged spacing between the strip-guide members and the mandrel or coil on the mandrel to accommodate various thicknesses of rolled strip but can also be provided with a position-controlled setting or servocylinder which can be hydraulically pressurized and which can provide reliable and accurate spacing between the guide members and the mandrel.

During the coiling or relatively thick strips and even during the insertion of such strip into the coiling assembly, where the gap between the strip-guide members and the mandrel may range from 10 to 30 mm, distortions can occur which detrimentally affect the successive turns of the coil and may result in kinking, plastic deformation or stress regions in the strip. This is a so-called curbstone effect which can result from acceleration of the mass under the effect of the static pressing forces during overrunning at the inlet end of the strip. With the servocontrolled or other accurate positioning of the strip-guide members, the leading end of the strip can be intercepted by a guide gap which can be spread as necessary and returned to its optimum dimension subsequently so that such damage does not occur.

For the detection of the position of the leading end of the strip on the mandrel, an automatic sensor can be used of the type which has been utilized heretofore for the automatic control of the spreading of the mandrel. The control system can take into account the strip thickness and speed. The setting of the gap between the pressing-roller unit and the mandrel in accordance with the respective strip thickness can be affected by the hydraulic position-controlled setting cylinder utilizing conventional servomechanism practices. For example, the set-point value can be provided to a comparator which also receives the actual value signal from a position sensor between a fixed abutment.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
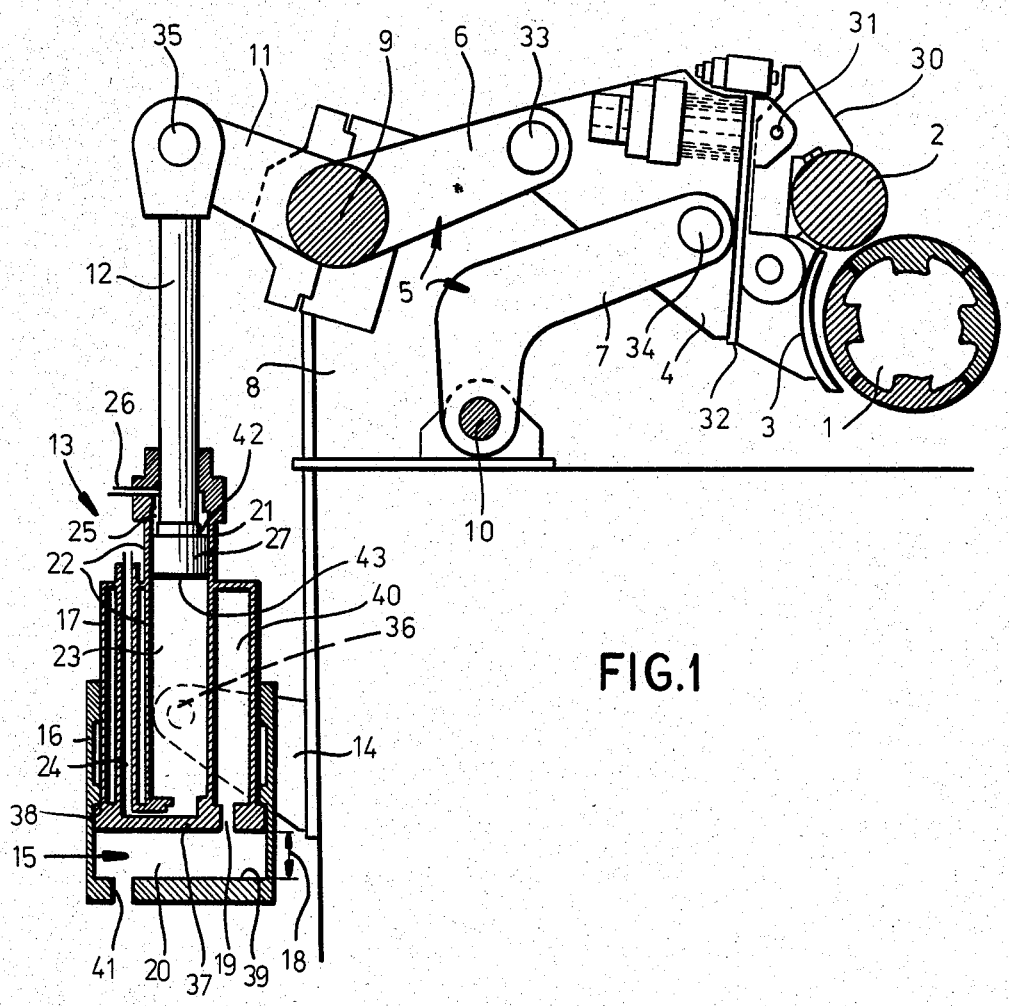
FIG. 1 is a side view, partially in section through the mandrel and one of the positioning units for a pressing roll or deflecting plate, serving as a strip guide member, for a strip-coiling apparatus which, it should be understood, may have a plurality of such guide members and respective positioning devices spaced apart around the mandrel, the strip coiler being preferably a subfloor coiler for a hot-rolling strip mill line.

In FIG. 1, we have shown a coiling mandrel 1 representing the usual strip coiling machine for a subfloor strip coiler in a hot strip mill, especially for the production of strip steel.

The mandrel 1 cooperates with a drive (not shown) as well as with a plurality of guide members which can be either pressing rolls 2 or strip deflecting plates 3, or both, which can be positioned relative to the mandrel 1 by respective mechanisms. Generally a plurality of such mechanisms and guide members are provided in spaced-apart relationship around the mandrel. As the strip is fed thereto, it is guided onto the mandrel and then onto preceding turns of the coil as it is built, the pressing rolls ensuring gradual conformation to the coil curvature and establishing the tightness of the coil winding.

The pressing rolls 2 and the deflecting plate 3 are mounted upon a carrier 4. The roll 2 can be received in a pivotable member 30 articulated at 31 to a flange 32 of the carrier which, between the pivots 33 and 34 of a four-pivot linkage, forms one arm of this linkage.

The four-pivot linkage generally represented at 5, comprises a pair of arms 6 and 7 which have pivots 9 and 10, respectively, on a fixed support or frame 8.

It will be apparent that the four-pivot linkage enables displacement of the roll 2 and the deflecting plate 3 generally parallel to themselves.

The arm 6 is formed as a bell crank lever having another arm 11 pivotally connected at 35 to a piston rod 12 of a pneumatic-hydraulic unit represented at 13 and carried by an outrigger 14 from the support frame 8. More specifically, the arm 14 has a pivot 36 upon which the cylinder housing 16 is swingably mounted.

Housing 16 defines a pneumatic cylinder 15 which cooperates with the pneumatic piston 37 so that the latter is of the limited stroke type, being displaceable between an upper abutment 38 and a lower abutment 39.

The pneumatic piston 37 is formed with a plunger portion 17 which extends axially away from the cylinder 15 and is hollow with the compartment 40 communicating continuously via the opening 19 in the bottom of the piston 37 with the working compartment 20 of the pneumatic cylinder.

The latter compartment communicates via a port 41 with a source of compressed air.

As a result, in spite of the relatively small displacement of the chamber 20, limited by the stroke 18 of the pneumatic piston, the total pneumatic volume is large, being equal to the volumes of the chambers 20 and 40. The result is a substantially constant spring characteristic and rate (spring constant for the compressed air in this space).

Upon application of the compressed air, the pneumatic piston is displaced upwardly, thereby extending the plunger 17 outwardly into the position shown in the drawing.

The plunger portion 17 encloses a double-acting hydraulic cylinder 22 which extends axially beyond the plunger and has compartments 23 and 25 connected by passages 24 and 26 with a hydraulic fluid supply provided with the usual control valves.

Since the surface area of the surface 42 at one side of the piston 27 is less than the surface 43 on the opposite side thereof, the piston acts as a differential piston rigid with the connecting rod 12.

When chamber 23 of the hydraulic cylinder is pressurized, the piston 27 and the rod 12 are moved upwardly and the linkage is swung toward the mandrel to bring the roll 2 and/or the deflecting plate 3 into contact with the surface thereof.

By controlling the velocity of flow of the hydraulic fluid into chamber 23, the rate at which the roll 2 and the deflecting plate 3 is moved can be controlled easily. By regulating the pressure of the hydraulic fluid, we find it simple to control the pressing pressure of roll 2 against the mandrel.

Any selected position of the differential piston 27 can be locked in by balancing the hydraulic fluid forces in to compartments 23 and 25, thereby fixing the piston rod 12 and enabling further displacement of the roll only against the pneumatic cushion.

The locking of the hydraulic piston has been found to be especially desirable when, prior to the passage of the strip end into the coil, the pressing roll or deflecting plate have already been brought into a preliminary position during the coiling phase from which the remaining movement against the periphery of the coil can be effected with a reduced velocity so that the impact energy against the periphery of the coil is minimized and strip damage avoided.

To swing the pressing roll and the deflecting plate 3 away from the mandrel 1 after strip in-feed, the chamber 23 of the hydraulic cylinder is relieved and hydraulic fluid is fed to the chamber 25, thereby displacing the differential piston 27 downwardly and drawing away the linkage and the roll or plate from the mandrel.

Outward displacement of the pressing roll 2 and the deflecting plate 3 relative to the mandrel can occur either at the inception of the coiling process upon the overlapping of the leading end of the strip or at the conclusion of coiling when the trailing end of the strip passes between the pressing roll and the coil. These sharp displacements are taken up exclusively by the pneumatic cylinder 15 and hence the instantaneous acceleration is accommodated by the elastic compression of the air in the chambers 20 and 40. Because of the large air volume and high compressibility of the air, the spring constant formed by the pneumatic cylinder is substantially constant. Also the air pressure in the pneumatic cylinder can be set independently of the working pressure in the hydraulic cylinder and controlled independently thereof so that any desired spring constant can be established.

It has been found to be advantageous to connect the port 41 to a pneumatic source capable of maintaining a preset constant pressure which is adjustable, so that effective control is obtained and air leakage losses are made up.

The hydraulic cylinder 22 can have the so-called double-brake valve which is effective in both load directions and can serve as a holding valve as well. It can also act as a pressure limiter for the hydraulic tubing and allow uniform, jerk-free movement of the deflecting plate through relatively small displacements and under various force applications against the strip.

Figure 2:
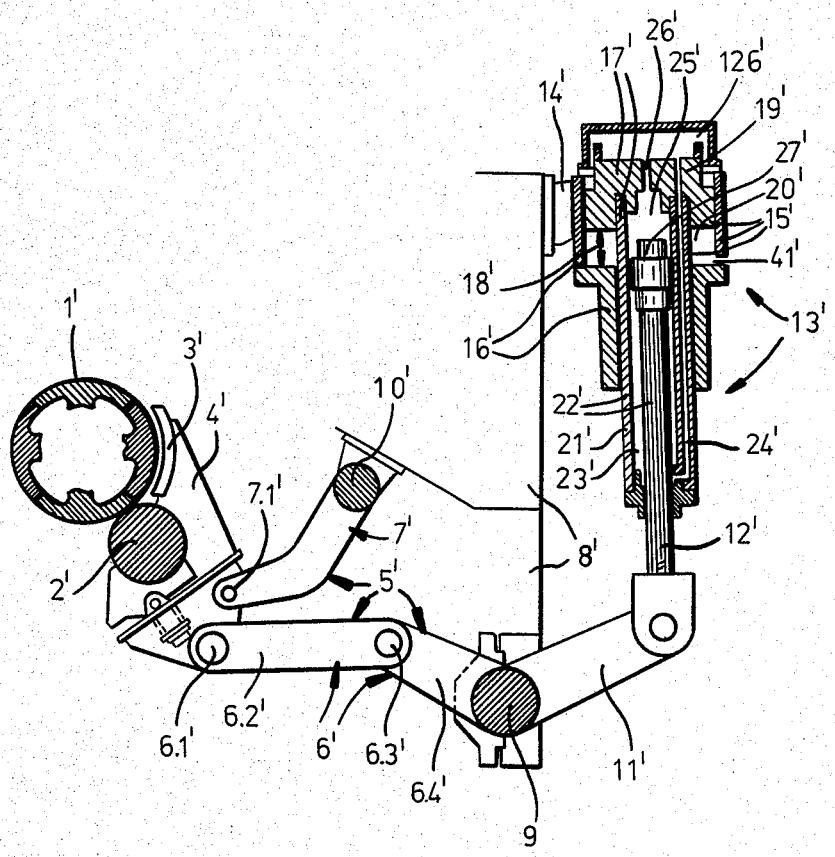
FIG. 2 is a view similar to that of FIG. 1 but illustrating a further improvement in the positioning device for the guide member of a subfloor coiling assembly.

In FIG. 2 we have shown a subfloor coiler in which elements which correspond to those of FIG. 1 have been represented either with primed reference numerals or with reference numerals in a hundred series otherwise corresponding to the reference numerals used in FIG. 1. In this embodiment, a pressing roller 2' and a guide plate 3' are shown to be juxtaposed with the coiling mandrel 1'. These two guide members are mounted on a common carrier 4' which is connected by a four-member linkage represented at 5' to the positioning device. More particularly, the carrier 4' is articulated by 6.1' to a link 6.2' which, in turn is pivotally connected at 6.3' to an arm 6.4' of a bell crank lever 11' fulcrumed at 9' on the frame, foundation or other substructure 8' of the subfloor coiler. The member 6.1' through 6.4', of course, correspond to the member 6 represented in FIG. 1 and since this member 6 is subdivided in the embodiment of FIG. 2, a five-member linkage may thus result.

The linkage 7 of FIG. 1 corresponds to the link 7' of FIG. 2 which is articulated at 7.1' to the carrier 4' and at 10' to the fixed frame 8'.

The bell crank lever 11' is pivotally connected to the piston rod 12' of the pneumatic-hydraulic positioning unit 13' which is mounted on an outrigger arm 14' of the frame so as to enable the assembly to pivot about a pivot point not shown but equivalent to the pivot 36 of FIG. 1.

The positioning device 13' comprises a pneumatic cylinder 15' which, in turn, is formed by a cylinder housing 16' and a plunger or tube piston 17'. The stroke of the pneumatic cylinder is limited to the displacement represented at 18'. This stroke is short by comparison to the stroke of the hydraulic cylinder.

The plunger or tube piston 17' forms a step piston of relatively large volume with a massive head 19' which is displaceable in the housing 16' and defines the upper side of the pressure compartment 20' which receives compressed air from an appropriate valve via a port 41'.

The tubular neck 11' of the plunger piston 17' extends downwardly from the housing 16' of the pneumatic cylinder 15'.

The plunger of tubular piston 17' thus is suspended in the cylinder housing 16' of the pneumatic cylinder 15' and, via the compartment 20' is under pneumatic pressure and is biased into a retracted position as will be apparent from FIG. 2.

The neck 21' is guided in the sleeve-like extensions of the cylinder housing which serves the neck.

So that the pneumatic cylinder 15' in spite of its relatively small volume in the compartment 20' can operate with a large air volume (compare FIG. 1), it is advantageous to connect the compartment 20' at its lower end to a pressure accumulator (not shown) which may remain in constant communication with the compartment 20'. By thus increasing the air volume available to cushion the movement of the pneumatic piston over the entire stroke 18', the spring rate over the entire stroke of the piston 17' can remain more or less constant as has been described heretofore.

Within the plunger piston 17' and especially in the tubular neck 21' thereof, a double acting hydraulic cylinder 22' is formed. This double-acting hydraulic cylinder 22' can have one of its working chambers 23' connected via a passage 24' with its other working passage 25' for differential piston action. To this end the passage 24' and the passage 26' of the compartment 25' may open through the bottom 19' of the piston 17' into a chamber 126' representing a source of hydraulic fluid under pressure The bottom 19', forming the head of the piston 17' thus can be comparatively thick or massive.

In the embodiment illustrated, the hydraulic piston 27' of the cylinder 22' is a differential piston which is rigid with the piston rod 12' and upon pressurization of the hydraulic piston is displaced downwardly but upon depressurization can be urged by the linkage and the bell-crank lever 11' upwardly.

Alternatively, the compartments 23' and 25' can be separately energized with hydraulic fluid so that, for example, pressurization of the compartment 23' will result in upward movement of the piston 27' within the piston 17', thereby lifting the piston rod 12' and rotating the bell-crank lever 11' in the counterclockwise sense tending to swing the carrier 4' in such manner as to move the pressing roller 2' and the guide plate 3' toward the periphery of the mandrel 1'.

By controlling the feed of the hydraulic fluid to the compartment 23', the rate of movement of the roller 2' and the guide member 3' can be regulated. By regulating the pressure of the hydraulic fluid, the pressing force of the roller against the mandrel or strip wound thereon can be established as desired. Naturally, the differential piston 27' can be fixed in any selected position and can be used to damp movements of the piston rod 12'.

This mode of operation is especially advantageous for presetting the positions of the pressing roller and/or the guide plate 3' during the initial phase of coiling the strip on the mandrel and then moving the pressing roller or the guide plate toward the mandrel to establish the desired minimum clearance. This reduces the impact energy of the leading end of the strip upon the assembly to a minimum and minimizes damage to the strip as previously noted.

To swing the roller 2' and/or the guide plate 3' away from the mandrel, the compartment 23' can be depressurized or the compartment 25' can be pressurized in such manner that the differential piston 27' is displaced downwardly to shift the five-point linkage 5' so as to move the roller and guide plate away from the mandrel. While, for convenience the passages 26' and 24' have been shown to be connected together, it should be understood that this connection need only be effective when differential piston action is desired and that these passages may be separately connected to a control valve for individual pressurization or depressurization of the working compartment.

Outward movements of the strip guide members which may be forced as a new strip end is fed onto the mandrel or the previous portion of the coil thereon to overlap an earlier strip can be taken up exclusively by the pneumatic cylinder 15'. The instantaneous acceleration of the latter is transferred to it by the five-member linkage 5', the piston rod 12' and the piston 17' which is hydraulically locked thereto.

The elastic suspension of the latter piston is provided by the working compartment 20' and the separate pressure accumulator which has previously been described with a constant spring rate because of the high air volume and compressibility.

It is important in the latter mode of operation that the air pressure in the pneumatic cylinder 15' be completely independent of the working pressure in the hydraulic cylinder 22' and be controlled independently thereof to enable the spring rate of the pneumatic cylinder 15' to be selected as well.

It is also advantageous to minimize air consumption of the pneumatic cylinder by restricting leakage losses, pressure fluctuations and associated movements so that the operation of the device is as economical as possilble.

It has also been found to be advantageous to mount the positioning device 13' so that it lies above the working plane or the mandrel 1' and can be suspended in a foundation pit or channel conveniently provided in the mill.

In this case, the guide members are displaced by a planar five-membered linkage 5' so arranged that not only the mass of the pneumatic-hydraulic positioning device 13', but also the mass of the total pressure roll assembly including the pressure rollers 2' and/or the guide plate 3', acts in a direction tending to swing the strip guide members away from the periphery of the coiling mandrel 1'. This not only improves the sensitivity of the positioning device but also makes the swing away from the mandrel automatic upon failure of the pressure or hydraulic supply to the positioning device.

Figure 3:
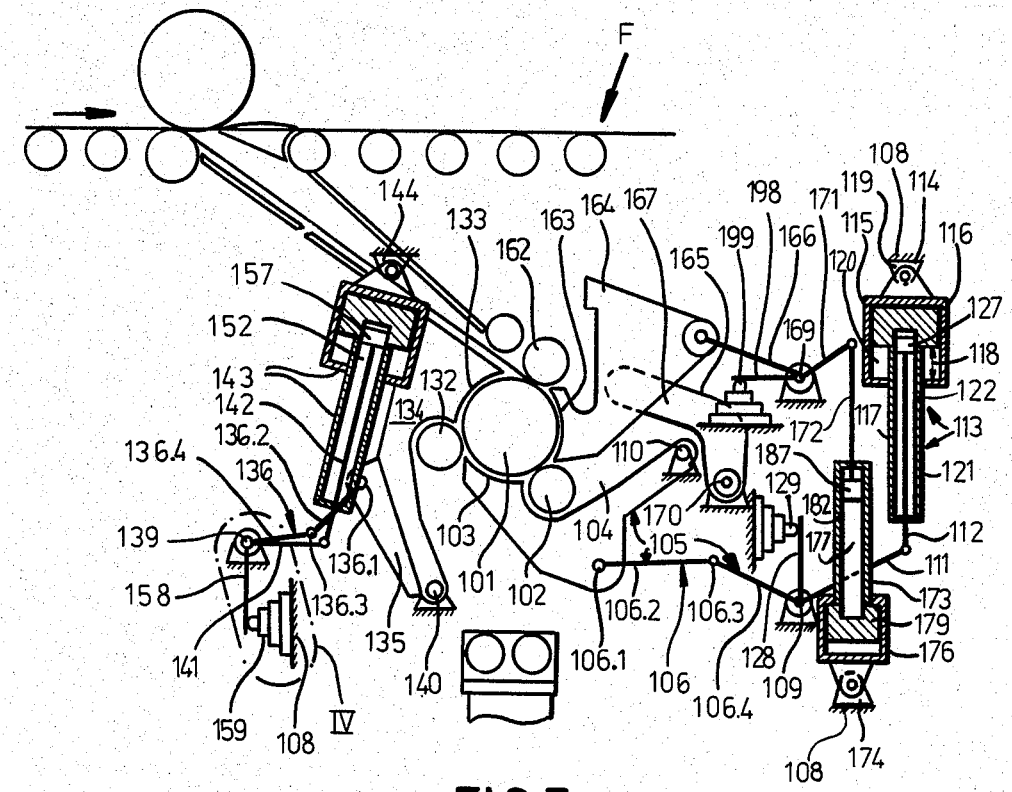
FIG. 3 is a diagrammatic simplified side-elevational view partly in section of a complete subfloor coiler showing the rolling mill stretch thereabove and provided with a plurality of pressing rollers and/or guide plates and the associated positioning devices.

In the coiler represented in FIG. 3, in which the floor of the mill is represented generally at F, the mandrel 101 is shown to be surrounded by three angularly spaced pressing rollers 102, 132 and 162, while three guide plates 103, 133 and 163 are juxtaposed with the periphery of the coiling mandrel 101.

These strip guide members are mounted on common roller or plate carriers 104, 134 and 164. The pressing roller 162 is the first pressing roller of the subfloor coiler while the pressing rollers 102 and 132 constitute second and third pressing rollers, respectively.

The roller end plate carrier 104 is movable relative to the coiling mandrel 101 on a stationary frame 108 via a linkage 105 while a similar linkage 135 acts upon the carrier 134 and a further linkage 165 is connected to the carrier 164.

The linkage 105, although functionally similar to that of the linkage 5' of FIG. 2, has a different configuration in that a lever corresponding to the lever 7' is avoided. In this embodiment, the carrier 104 is pivotally mounted at 110 on the frame 108. The linkage 105 thus is a four-member linkage including the toggle lever 106.

A bell-crank lever 106.4 of the toggle lever 106 is swingable on the fixed fulcrum or pivot 109 of the frame and is connected with the arm 111 pivotally connected to the piston rod 112 of the positioning device 113. The positioning device functionally and structurally corresponds to the positioning device 13 of FIG. 2.

Another difference between the embodiment of FIGS. 2 and 3 is that the positions of the guide plate 103 and the roller 102 are reversed with respect to the direction of rotation of the mandrel 101, i.e. are not arranged ahead of the point at which the strip meets the drum but rather behind this point. This difference is, of course, the difference resulting from the difference in constructions of the linkages 5' and 105 and thus the different ways in which the carriers 4' and 104 move.

Similarly, the carrier 134 or the roller 132 and the guide plate 133 is pivotally mounted directly at an axis 140 on the frame 108.

The crank lever 136.4 of the linkage 135 is swingable about an axis 139 on the frame 8 and is connected by the link 136.3 with a link 136.2 which engages the carrier 134 via another link 136.1. The members 136.4 and 136.2 are connected together by a pivot 136.3 which forms with them a toggle linkage 136.

An arm 141 is rigidly connected with the lever 136.4 and is pivotally connected to the piston rod 142 of a positioning device 143 which structurally and functionally corresponds to the positioning device 13 of FIG. 2. The positioning device 143 is also swingable via a connecting member 144 on the fixed frame 108.

Consequently, the linkage 135 is a four-member linkage so that the carrier 135 has the same type of movement as the carrier 104. In this embodiment as well the pressing roller 132 lies behind the guide plate 133 with respect to the direction of rotation of the mandrel 101.

The layout and configuration of the carrier 164 for the pressing roller 162 and the deflecting plate 163 corresponds to those of German patent document No. 30 26 524.

The linkage 165 is formed as a linkage quadrangle with the two levers 166 and 167 swingable about pivots 169 and 170 in the frame 108. An arm 171 which is pivotally connected to the piston rod 172 of the pneumatic-hydraulic positioning device 173, engages the lever 166 and the positioning device is swingable via a member 174 on the frame 108.

The pneumatic-hydraulic device 173 has thus basically the same construction and mode of operation as the two other pneumatic-hydraulic devices 113 and 143 although it is not suspended pendulously in the stationary frame 108, but is upstanding therefrom as is clear from FIG. 3.

Since the two hydraulic-positioning units 113 and 173 are disposed within the foundation channel of the subfloor coiler direclty adjacent one another, the entire system is especially advantageous in that it requires comparatively little space. This advantage is particularly relevant when the first positioning unit 113 is suspended from the top and hangs downwardly while the other pneumatic-hydraulic positioning unit 173 is upstanding or upright. The latter unit is pivotally mounted on the foundation at 174.

Since the basic structures and modes of operations of all of the pneumatic-hydraulic positioning units 113, 143 and 173 are identical and correspond to the description of FIG. 2, the costs of the assembly can be reduced. In need only be noted that the pneumatic-hydraulic positioning device 173 operates in the opposite direction from the direction of operation of the units 113 and 143 because of its upright orientation so that the head 79 of its plunger or tube piston 177 is braced not at its ring or piston rod side, but at its free end at the air cushion of the cylinder housing 176. The piston rod 172 of the pneumatic-hydraulic device 173 bears with pressure upon the arm 171 via the piston 187 of the hydraulic cylinder 182.

FIG. 3 also shows that the linkage 105 for the carrier 104 cooperates via an abutment lever 128 with a position detector 129 on the stationary frame 108. The position detector provides an actual value signal representing the position of the carrier 104.

Thus the abutment lever 128 is rigid with the swingable lever 106.4 and the arm 111 and can pivot about a stationary axis 109.

A similar abutment lever 158 with a corresponding position sensor 159, is mounted on the arm 141 and moves with the swingable lever 136.4 about the pivot 139 on the stationary support 108 upon which the position sensor 159 is mounted. The latter thus provides corresponding position control for the linkage 135 of the carrier.

Finally, abutment lever 98 is formed in one piece with the lever 166 and the arm 171 and is swingable about the pivot 169 when it cooperates with a position sensor 199 on the frame 108 or the linkage 165.

Figure 4:
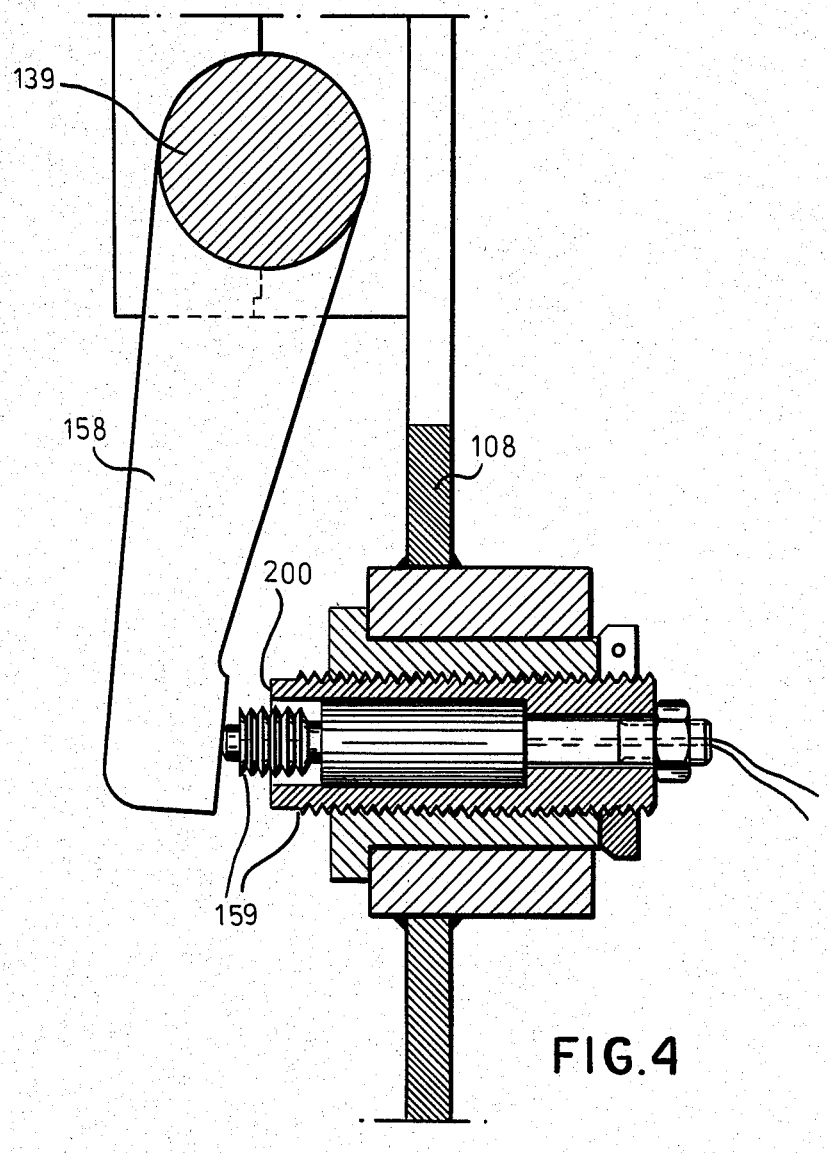
FIG. 4 is a detail view, partly in section, of the mechanism represented at IV in FIG. 3.

FIG. 4 shows, to an enlarged scale, the abutment lever 158 and the position sensor 159 associated therewith for the carrier 134 of the linkage 135. The abutment lever 128 of its sensor 129 and the abutment lever 198 of its sensor 199 can be of similar construction.

The positioning sensor 129 cooperates with the fluid pressure control system or the hydraulic cylinder 122 of the positioning device 113 while the sensor 159 cooperates with the hydraulic control system or cylinder 152 forming part of the positioning device 143 and whose piston 157 carries the piston rod 142.

The position sensor 199 cooperates with the hydraulic control system for the cylinder 182 of the pneumatic hydraulic device 173 whose piston 187 carries the piston rod 172.

With the aid of the position sensors 129, 159 and 199, the hydraulic cylinders 122, 152 and 182 of the positioning devices 113, 143 and 173 are transformed into a position-control servomechanism by means of which the spacing between the coiling mandrel 101 and the pressure rolls 102, 132 and 162 and between the mandrel 101 and the guide plates 103, 133 and 163 can be readily set to the requisite strip thickness.

Figure 5:
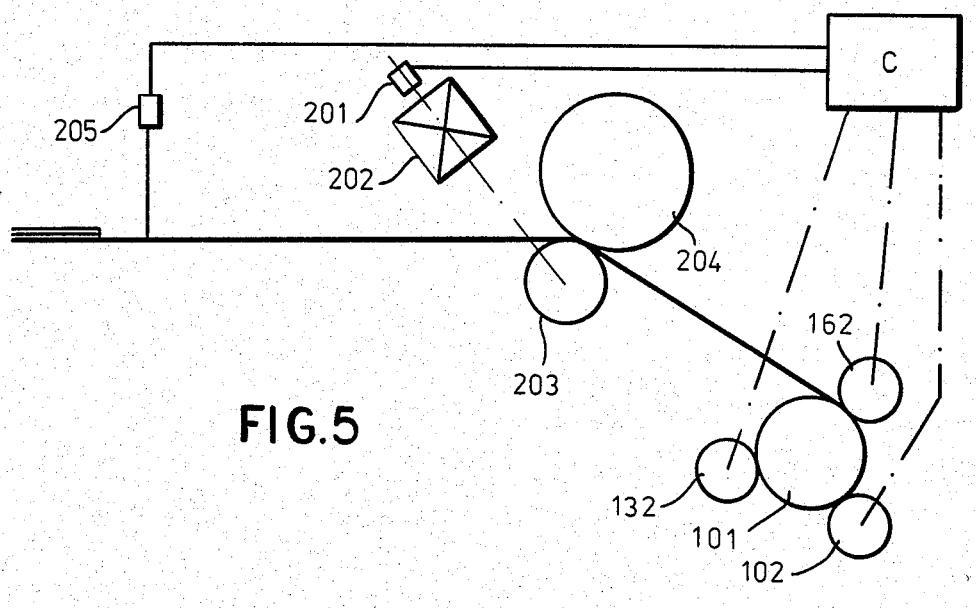
FIG. 5 is another diagrammatic view of a subfloor coiler showing control elements for the infeed of the strip thereto.

The desired set point values for the strip thickness are either introduced manually by the operator or automatically from a computer or calculator/memory system, e.g. as represented at C in FIG. 5, for the respecive actual value position sensors 129, 159 and 199 so that the respective error signals or difference signals are utilized to control valves for the hydraulic/pneumatic positioning devices in accordance with the principles of conventional servomechanism operations. These principles are developed in chapters 3 ff. of *Servomechanism Practice*, McGraw Hill Book Company, New York (1960).

The position detectors 129, 159 and 199 are so juxtaposed with the respective abutment levers 128, 158, and 198 that they respond to the distances between the respective roll and guide plate carriers 104, 134 and 164 and the periphery of the mandrel and hence the spacing between the pressing rollers 102, 132 and 162 or the guide plates 103, 133 and 163 and the periphery of the mandrel 101.

Deviations from the desired set point values are responded to by the positioning devices and are reflected in feedback movements of the abutment levers 128, 158 and 198 as detected by the position sensors 129, 159 and 199.

To ensure that, even in the event of overcorrection or a failure of the hydraulic/pneumatic systems, the pressing rollers 102, 132, 162 or the guide plates 103, 133, 163 do not contact the periphery of the mandrel 101 directly, each of the position sensors 129, 159, 199 can have affixed abutment surface 200 (See FIG. 4) against which the respective abutment lever 128, 158 or 198 can come to rest and thereby block further movements of the linkage 105, 135, 165.

In order to enable the setting of the gap on the one hand between the mandrel 101 and the pressing rollers, 102, 132 and 162 and, on the other hand, between the mandrel 101 and the guide plates 103, 133, 163, we may utilize the set point inputs from the operator or the computer and can manually or automatically provide for the feed of thicker strip and a stepwise opening of the gap for the input end. The stepwise opening of the gap for the coiling of thick strip, especially at start up, can be effected between 10 and 30 millimeters in subfloor coilers, thereby avoiding practically completely the curbstone effect and other damage to the strip to be coiled.

In general, the damage to the band upon the coiling of thick strip is a result of subsequent turns overlying the leading edge of the strip. In these regions, the pressure against the successive turns causes plastic deformations especially when the guide members are statically positioned and roll over the strip periphery.

To avoid the curbstone effect, the successive pressing rollers 162, 102 and 132 in the direction of rotation of the mandrel 101 are actuated by the respective hydraulic cylinders 182, 122 and 152 in the respective pneumatic-hydraulic positioning devices 173, 113, and 143 rhythmically or sequentially so that each of them ahead of the arrival of the leading edge of the strip on the mandrel is moved away from the mandrel to a certain extent beyond the normal gap distance and to such a point that the subsequent turns when they over roll the leading edge of the mandrel do not press forcibly thereagainst so as to produce the curbstone effect. For the automatic adjustment of the positions of the rollers and the guide plates in this fashion, a travel detecting system is utilized to control the hydraulic feeds to the cylinders 182, 122 and 152.

This travel detecting system can be constituted as shown in FIG. 5 with a rotation counter 201 in the form of an angle stepping signal generator which is preferably mounted on a shaft of the drive motor 202 for the lower drive roller 203 of the feeder 204 provided upstream of the subfloor coiler along the rolling mill path.

Upstream of the drive unit 204 at a predetermined spacing therefrom, for example about 15 meters, we provide a photocell 205. As soon as the leading edge of a strip reaches this photocell 205, the counter 201 is triggered to count increments of displacement of the strip. The number of such increments, mathematically combined with the diameter of the lower drive roller indirectly provide a measurement of the distance from the leading edge of the strip. Since the distance between the photocell 205 and the mandrel 101 is invariable and a known quantity, the position along the strip can be utilized to provide an input for the stepwise opening of the pressing rollers 162, 102 and 132 at the optimum points in time. For the stepwise opening of the pressing rollers 162, 102 and 132, for use with the actual value sensors 199, 129 and 159, the set point values for the hydraulic cylinders 182, 122 and 152 can be increased by appropriate amounts bearing in mind, of course, the increase in diameter of the coil in dependence upon the strip thickness, and the speed.

It can be noted again that the linkage 5' of FIG. 2 does not correspond exactly to the linkage 105 of FIG. 3. In the system of FIG. 2, the pivot 7.1 and a linkage 7 are provided which have no counterparts in the system of FIG. 3. In the latter system, the carrier 104 is directly mounted swingably at 110 on the support.

The linkage 5' of FIG. 2 is utilized only for the first pressing roller of a subfloor coiler having more than one pressing roller, corresponding to the pressing roller 162 of FIG. 3. The linkage 5' of FIG. 2 can thus be substituted for the linkage shown at 65 in FIG. 3 while the remaining linkages of the FIG. 3 system can remain as illustrated and described.

We claim:

1. A positioning device for a strip-guide member, in combination with a strip-coiling mandrel, of a strip coiler, said device comprising:

a linkage carrying said member and displaceable to shift said member toward and away from said mandrel; and an elongated pneumatic-hydraulic unit connected to said linkage, said unit comprising pneumatic cylinder means including a pneumatic cylinder having a working chamber and a pneumatic piston, means forming a hydraulic cylinder carried by said pneumatic piston and having a hydraulic piston connected to said linkage for displacing same, means for independently hydraulically pressurizing said hydraulic cylinder and pneumatically pressurizing said pneumatic cylinder, and means for supporting said unit at an upper end thereof, said pneumatic piston being tubular and enclosing said hydraulic cylinder, said hydraulic piston extending downwardly out of said tubular piston.

2. The device defined in claim 1 wherein said pneumatic cylinder is formed with a plunger portion extending in the direction of displacement of said pneumatic piston and extending from said pneumatic cylinder means in a limited-stroke position of said pneumatic cylinder.

3. The device defined in claim 2 wherein said plunger portion is hollow and contains compressed air communicating with compressed air in said pneumatic cylinder.

4. The device defined in claim 1, wherein the stroke of said hydraulic piston is greater than that of said pneumatic piston and is at least equal to the length of an elongated portion of said pneumatic piston provided with said hydraulic cylinder.

5. The device defined in claim 1, wherein said hydraulic piston is formed as a differential piston and defines in said hydraulic cylinder a pair of independently pressurizable working compartments.

6. The positioning device defined in claim 1 wherein said hydraulic cylinder has two compartments and a bottom at its upper end, said bottom being provided with passages opening upwardly and communicating with said compartments.

7. The positioning device defined in claim 1 wherein upon hydraulic pressurization of said chamber, said means forming said hydraulic cylinder is drawn further into said pneumatic cylinder means.

8. The positioning device defined in claim 1 wherein said linkage includes an arm articulated on a support, a pivot lever connected with said arm and swingably displaceable about an axis, a carrier for said member, and a toggle lever connecting said carrier to said pivot lever whereby said levers and said carrier form a five-member planar linkage.

9. The positioning device defined in claim 1, further comprising a carrier for said member connected to said linkage, said carrier being directly swingable on a fixed frame, said linkage and said carrier forming a four-pivot swingable structure for positioning said member relative to said mandrel.

10. The positioning device defined in claim 1, further comprising a position detector for said linkage and control means responsive for said position detector for regulating the position of said member relative to said mandrel.

11. The positioning device defined in claim 10 wherein a plurality of such members is disposed in angularly spaced relationship around said mandrel and each of said members is provided with a respective carrier, and a respective pneumatic-hydraulic unit for displacing same.

12. The positioning device defined in claim 11, further comprising a strip displacement detector respective of the movement of said strip for actuating said units in succession to spirit said members away from said mandrel and return said units toward said mandrel as said strip passes around said mandrel.

13. The positioning device defined in claim 11 wherein the first of said members encountered by a strip as it coiled on said mandrel has a five-member linkage connecting it to its respective unit.

14. The positioning device defined in claim 10, further comprising programming means responsive to said position detector and included in said control means for regulating the position of said member with respect to said mandrel.

* * * * *